US010711459B2

(12) United States Patent
Mizuno et al.

(10) Patent No.: US 10,711,459 B2
(45) Date of Patent: Jul. 14, 2020

(54) INTERIOR PANEL AND INTERIOR PANEL STRUCTURE

(71) Applicants: AGC INC., Chiyoda-ku (JP); TOYOTA JIDOSHA KABUSHIKI KAISHA, Toyota-shi (JP)

(72) Inventors: Takanobu Mizuno, Nagoya (JP); Kentaro Oka, Tokyo (JP); Yasukazu Hiraoka, Tokyo (JP); Asuka Hoshino, Tokyo (JP); Hikaru Ishida, Tokyo (JP)

(73) Assignees: AGC INC., Chiyoda-ku (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/121,099

(22) Filed: Sep. 4, 2018

(65) Prior Publication Data

US 2019/0093347 A1 Mar. 28, 2019

(30) Foreign Application Priority Data

Sep. 4, 2017 (JP) ..... 2017-169530

(51) Int. Cl.
*E04B 2/74* (2006.01)
*E04B 2/82* (2006.01)

(52) U.S. Cl.
CPC ..... *E04B 2/827* (2013.01); *E04B 2/7403* (2013.01); *E04B 2/825* (2013.01)

(58) Field of Classification Search
CPC ..... E04B 2/827; E04B 2002/749; E05Y 2900/142; E05D 15/063; A47G 5/00
USPC ..... 52/243.1
See application file for complete search history.

(56) References Cited

U.S. PATENT DOCUMENTS 1,266,980 A * 5/1918 Norton ..... E06B 3/481 16/DIG. 31
3,444,919 A * 5/1969 Karoll ..... E06B 9/24 160/184
4,221,255 A * 9/1980 Barkemeyer ..... A47H 2/00 160/197
8,033,071 B2 * 10/2011 Miyata ..... E04B 2/827 52/239

(Continued)

FOREIGN PATENT DOCUMENTS

JP 2005-330762 12/2005
JP 2006-9478 1/2006

(Continued)

OTHER PUBLICATIONS

Shoji Designs, Inc. Modern Shoji Screen Installations (http://web.archive.org/web/20170521092803/http://www.shojidesigns.com/portfolio/heys.html, (Year: 2017).*

*Primary Examiner* — Brian E Glessner
*Assistant Examiner* — Daniel J Kenny
(74) *Attorney, Agent, or Firm* — Oblon, McClelland, Maier & Neustadt, L.L.P.

(57) ABSTRACT

An interior panel to be suspended and supported movably along a railway laid on a ceiling portion of a building, including: an upper panel member; a lower panel member disposed below the upper panel member; and a frame including at least an upper frame to be attached movably along the railway and a lower frame configured to hold a lower edge portion of the upper panel member and to hold an upper edge portion of the lower panel member.

15 Claims, 11 Drawing Sheets

(56) References Cited

U.S. PATENT DOCUMENTS

| | | | | |
|---|---|---|---|---|
| 8,151,527 | B2 * | 4/2012 | Gosling | E04B 2/7425 52/238.1 |
| 8,579,006 | B2 * | 11/2013 | Levin | E04B 2/827 160/184 |
| 2005/0086884 | A1 * | 4/2005 | Langenhorst | E04B 9/003 52/455 |
| 2008/0104908 | A1 * | 5/2008 | Jensen | A47G 5/00 52/241 |

FOREIGN PATENT DOCUMENTS

| | | |
|---|---|---|
| JP | 2006-28809 | 2/2006 |
| JP | 2007-32029 | 2/2007 |
| JP | 2009-52254 A | 3/2009 |
| JP | 2009-108514 | 5/2009 |
| JP | 2012-132296 | 7/2012 |
| JP | 2013-28920 | 2/2013 |
| JP | 2013-199768 | 10/2013 |
| JP | 2016-94721 | 5/2016 |
| JP | 2016-148168 | 8/2016 |
| WO | WO 2014/039278 A2 | 3/2014 |

* cited by examiner

INTERIOR PANEL AND INTERIOR PANEL STRUCTURE

TECHNICAL FIELD

The present invention relates to an interior panel and an interior panel structure.

BACKGROUND ART

Interior panels disclosed in Patent Documents 1, 2 are known as an interior panel to be set in an interior of a building. The interior panel of Patent Document 1 is an interior panel as an inner skin configured to be fixedly set on a building so as to face a curtain wall (also, referred to as an outer skin or an exterior skin) of a double-skin facade structure. The interior panel of Patent Document 2 is also an interior panel as an inner skin, but this interior panel includes a plurality of interior panels that are supported by a rail laid on a ceiling and a rail laid on a floor of a building.

On the other hand, although they are not interior panels as an inner skin, partition walls suspended movably from a rail laid on a ceiling of a building are known as disclosed in Patent Documents 3, 4. Patent Documents 3, 4 disclose the use of a glass panel as a panel of a partition wall.

PRIOR ART DOCUMENTS

Patent Documents

[Patent Document 1] JP-A-2005-330762
[Patent Document 2] JP-A-2013-199768
[Patent Document 3] JP-A-2006-28809
[Patent Document 4] JP-A-2016-148168

SUMMARY OF THE INVENTION

Problem that the Invention is to Solve

With the interior panel of Patent Document 1 that is installed on a building wall and the interior panel of Patent Document 2 that is supported at the lower portion of the panel, no restriction is imposed on the weight of the interior panel. However, since the interior panels disclosed in Patent Documents 3, 4 are constructed to be suspended, a reduction in weight has been demanded.

The present invention has been made in view of these situations, and an object of the invention is to provide, as a suspended interior panel, an interior panel that can realize a reduction in weight and an interior panel structure.

Means for Solving the Problem

To achieve the object, according to an aspect of the present invention, there is provided an interior panel to be suspended and supported movably along a railway laid on a ceiling portion of a building, including: an upper panel member; a lower panel member disposed below the upper panel member; and a frame including at least an upper frame to be attached movably along the railway and a lower frame configured to hold a lower edge portion of the upper panel member and to hold an upper edge portion of the lower panel member.

In the interior panel according to an aspect of the present invention, the upper panel member and the lower panel member preferably have a thickness of 10 mm or less, respectively.

In the interior panel according to an aspect of the present invention, the interior panel preferably has a vertical length of 2.5 m or more.

In the interior panel according to an aspect of the present invention, the lower panel member preferably includes a transparent member.

In the interior panel according to an aspect of the present invention, the transparent member is preferably a glass sheet.

In the interior panel according to an aspect of the present invention, the upper panel member preferably includes a member having a lower solar direct transmittance than a solar direct transmittance of the lower panel member.

In the interior panel according to an aspect of the present invention, the upper panel member preferably includes a member having a function of a heat shielding performance or an anti-glare performance.

In the interior panel according to an aspect of the present invention, the upper panel member preferably includes a glass, resin, metal or cloth.

In the interior panel according to an aspect of the present invention, it is preferable that the lower panel member has a left edge portion not held by a left frame and a right edge portion not held by a right frame, and an end face of the left edge portion and an end face of the right edge portion are exposed.

To achieve the object of the present invention, according to an aspect of the present invention, there is provided an interior panel structure including a plurality of the interior panels of the present invention disposed along a railway laid on a ceiling portion of a building.

In the interior panel structure according to an aspect of the present invention, it is preferable that the frame of the interior panel has a left frame configured to hold a left edge portion of the upper panel member and a right frame configured to hold a right edge portion of the upper panel member; and a transverse width of the lower panel member of the interior panel is smaller than a transverse width of the frame, and the left edge portion and the right edge portion of the lower panel member are disposed inside with respect to the left frame and the right frame, respectively.

In the interior panel structure according to an aspect of the present invention, the interior panel structure preferably includes a support member configured to support a lower edge portion of the lower panel member of the interior panel, in a floor portion of the building.

In the interior panel structure according to an aspect of the present invention, the interior panel structure is preferably disposed on an interior side of an outer skin provided on an outer circumferential surface of the building, with a cavity interposed between the interior side of the outer skin and the interior panel structure.

Advantageous Effect of the Invention

According to the present invention, a reduction in weight of the suspended interior panel can be realized.

MODE FOR CARRYING OUT THE INVENTION

Hereinafter, preferred embodiments of an interior panel and an interior panel structure according to the present invention will be described by reference to accompanying drawings.

Figure 1:
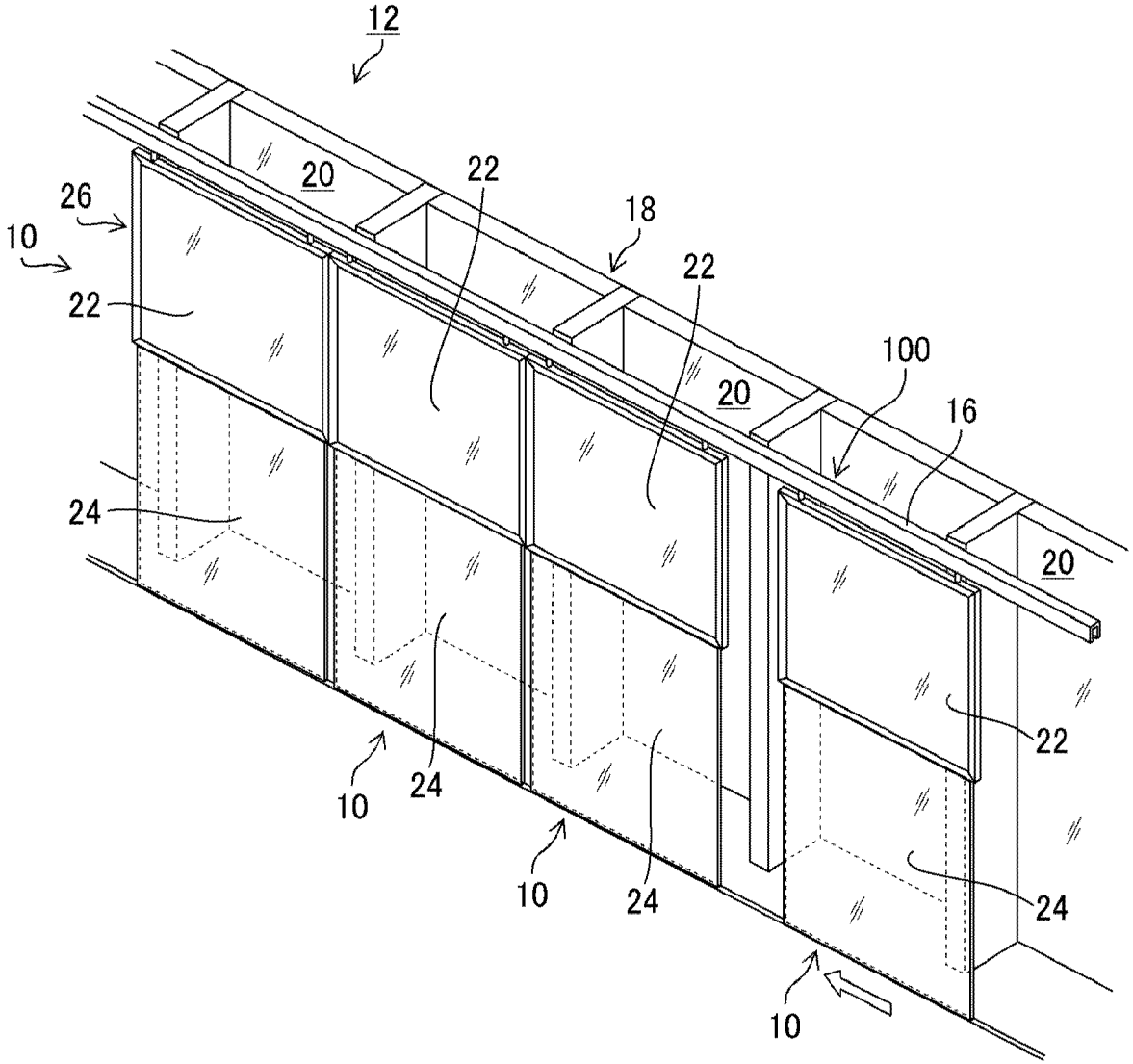
FIG. 1 is a perspective view illustrating an example of an interior panel structure according to an embodiment.
Figure 2:
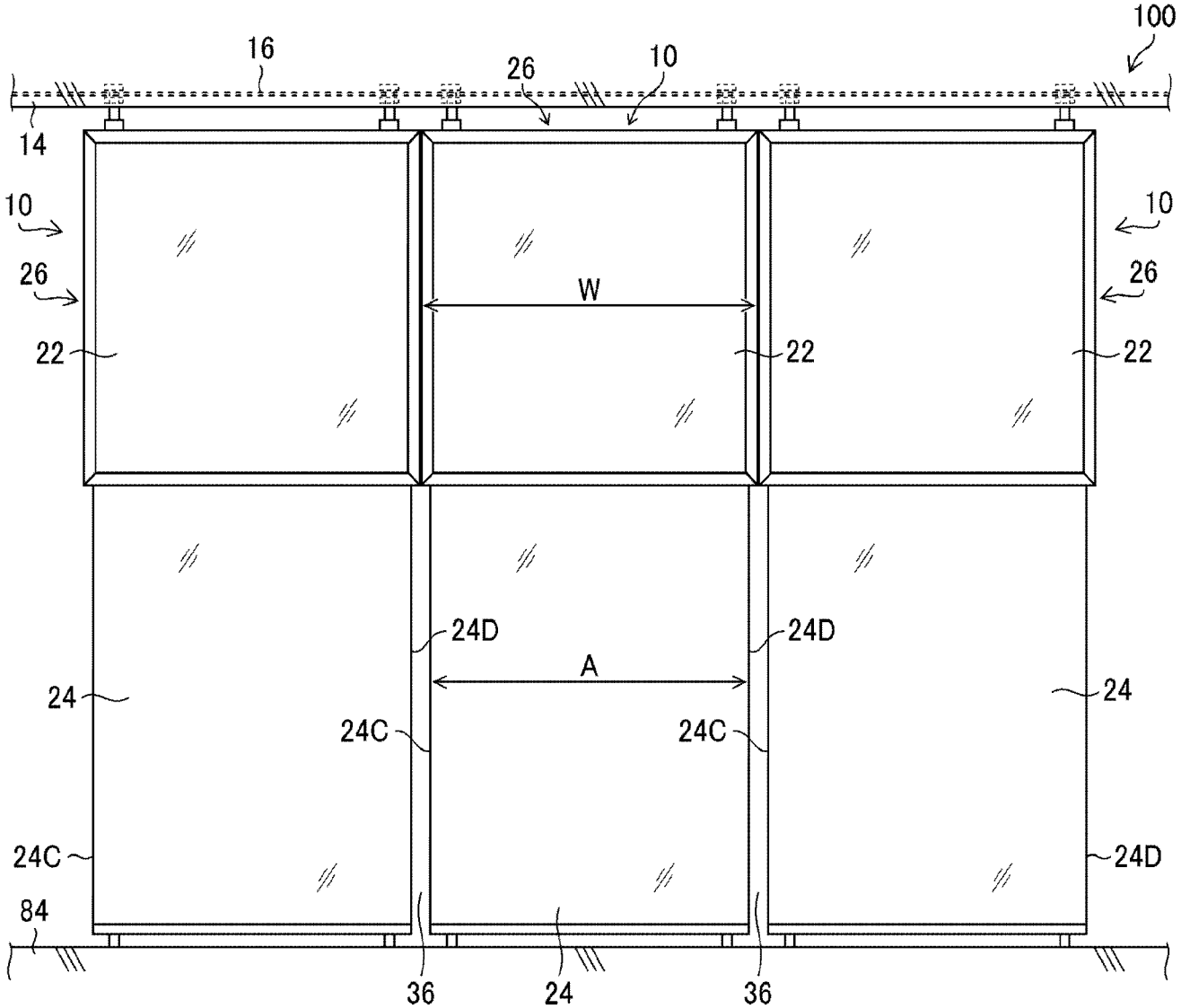
FIG. 2 is a front view of a main part of the interior panel structure shown in FIG. 1.

FIG. 1 is a perspective view illustrating an example of an interior panel structure 100 according to an embodiment, and FIG. 2 is a front view of a main part of the interior panel structure 100 shown in FIG. 1.

The interior panel structure 100 has a plurality of interior panels 10 according to the embodiment, and in the interior panel structure 100, the plurality of interior panels 10 are disposed along a railway 16 laid on a ceiling portion 14 (refer to FIG. 2) of a building 12 (refer to FIG. 1). The interior panel structure 100 is disposed so as to face an interior side of an outer skin 18 that is provided on an outer circumferential surface of the building 12 with a cavity 20 interposed there between as FIG. 1 illustrates. Namely, FIG. 1 illustrates the interior panel structure 100 that is applied to an inner skin of a double-skin facade structure.

Next, an outline configuration of the interior panel 10 according to the embodiment will be described. The configuration of the interior panel 10 will be described in detail later.

Figure 3:
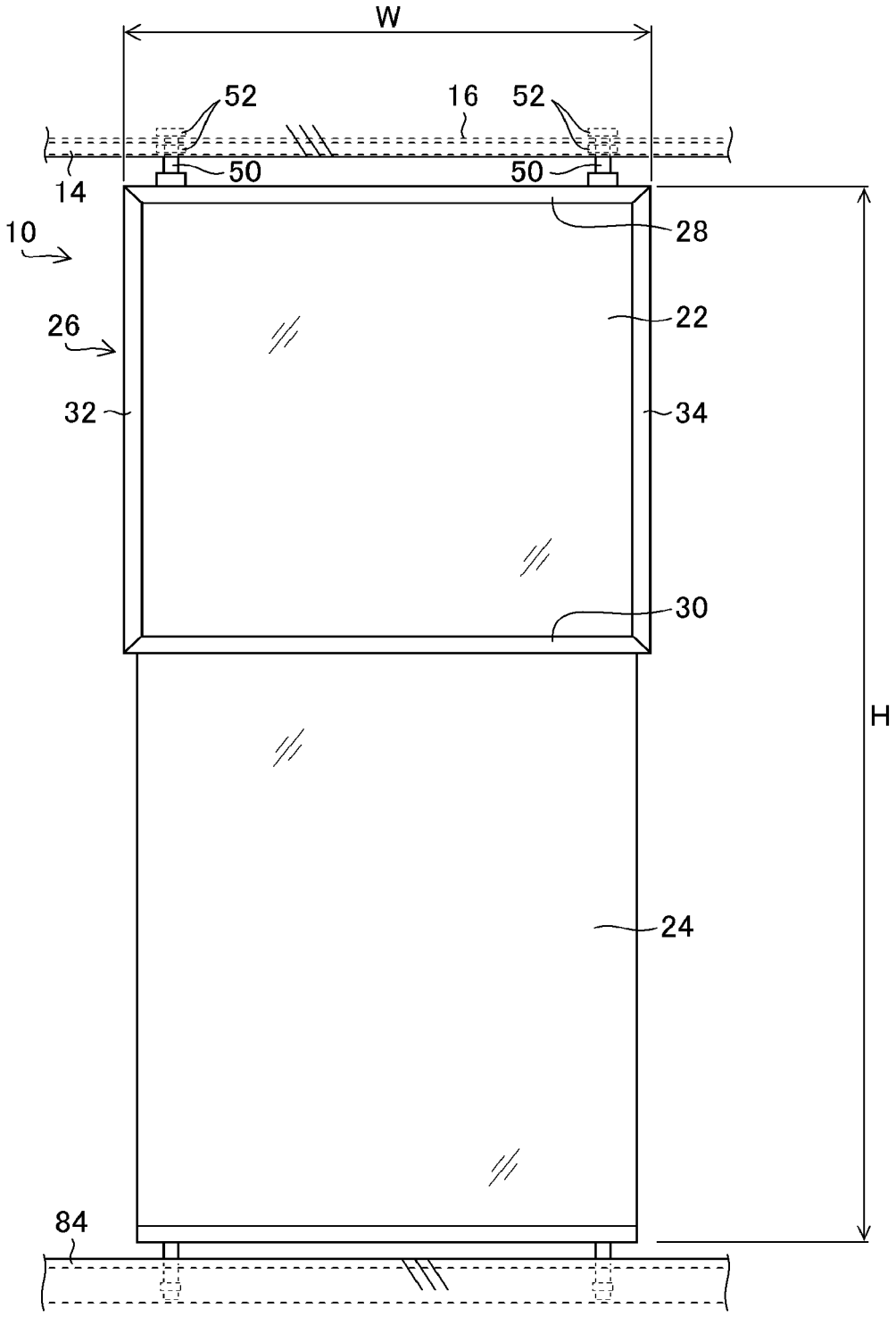
FIG. 3 is a front view of an interior panel of the embodiment.
Figure 4:
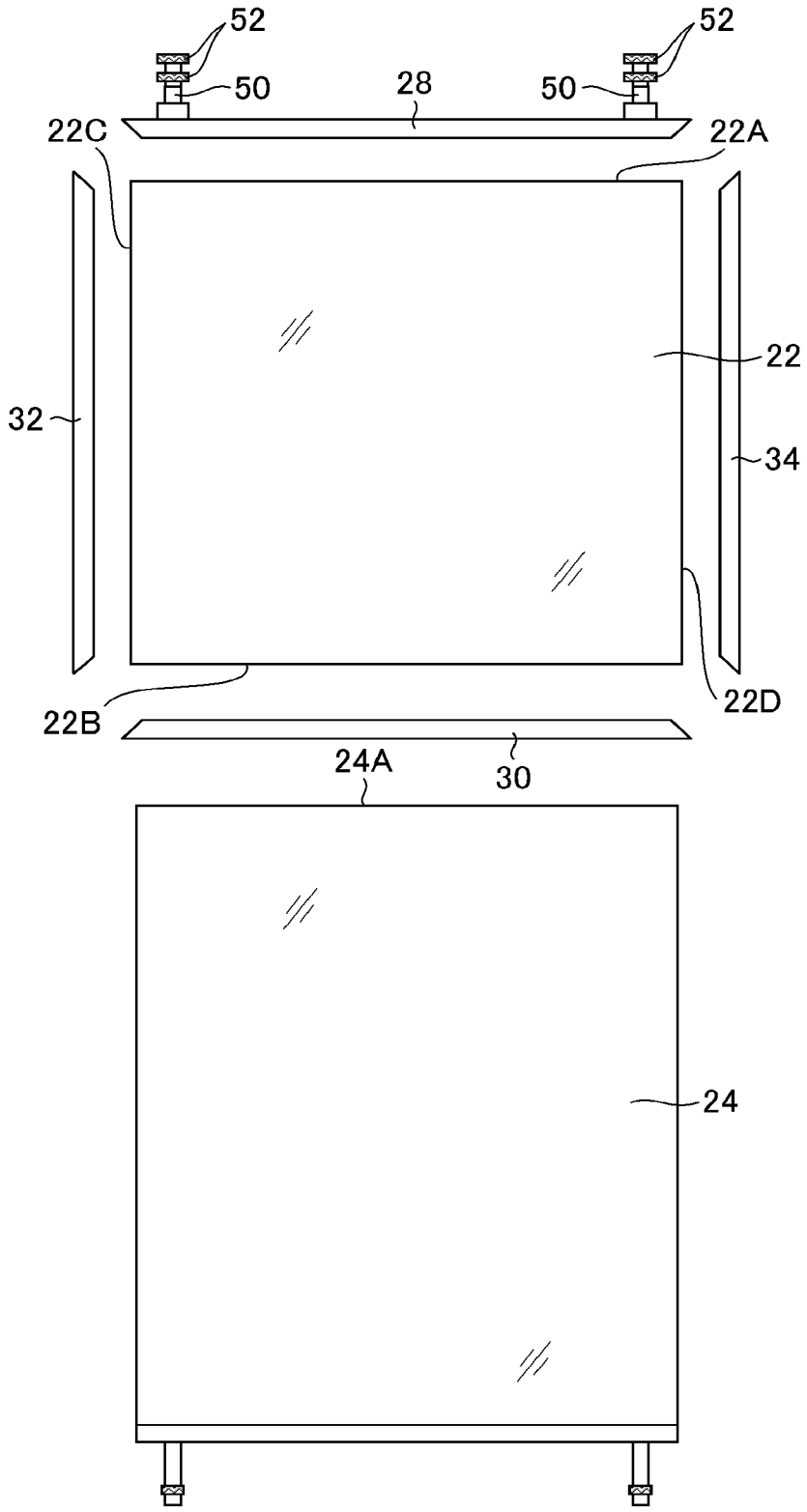
FIG. 4 is an assembly drawing of the interior panel shown in FIG. 3.
Figure 5:
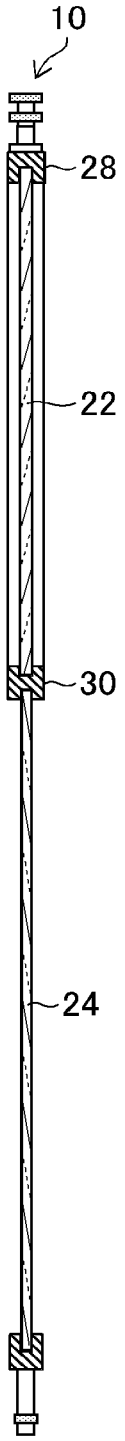
FIG. 5 is a longitudinal section view of the interior panel shown in FIG. 3.

FIG. 3 is a front view of the interior panel 10, FIG. 4 is an assembly drawing of the interior panel, and FIG. 5 is a longitudinal section view of the interior panel 10.

The interior panel 10 is a panel that is suspended and supported so as to move in a horizontal direction along the railway 16 shown in FIG. 3. This interior panel 10 includes a rectangular upper panel member 22 and a rectangular lower panel member 24 disposed below the upper panel member 22. Additionally, the interior pane 10 has a frame 26. The frame 26 has at least an upper frame 28 attached movably to the railway 16 shown in FIG. 3 and a lower frame 30 configured to hold a lower edge portion 22B of the upper panel member 22 and to hold an upper edge portion 24A of the lower panel member 24, as FIG. 4 shows.

The frame 26 of the embodiment has, in addition to the upper frame 28 and the lower frame 30, a left frame 32 configured to hold a left edge portion 22C of the upper panel member 22 and a right frame 34 configured to hold a right edge portion 22D of the upper panel member 22 and is formed into a rectangular frame shape as a whole.

The frame 26 of the embodiment exhibits a configuration in which the upper edge portion 24A of the upper panel member 22 is held by the upper frame 28 and the lower edge portion 22B, the left edge portion 22C and the right edge portion 22D of the upper panel member 22 are held by the lower frame 30, the left frame 32 and the right frame 34, respectively. In the case of the frame 26 having the left frame 32 and the right frame 34 as described above, while the upper panel member 22 is provided, the lower edge portion 22B, the left edge portion 22C and the right edge portion 22D of the upper panel member 22 may be held by the lower frame 30, the left frame 32 and the right frame 34, respectively, without holding the upper edge portion 22A of the upper panel member 22 by the upper frame 28. Although it is natural, when the frame is made up only of the upper frame 28 and the lower frame 30, the upper edge portion 22A of the upper panel body 22 is held by the upper frame 28, and the lower edge portion 22B of the upper panel body 22 is held by the lower frame 30.

An object of the present invention is to realize a reduction in weight of the suspended interior panel. Then, the interior panel 10 of the embodiment realizes a reduction in its weight by the following configuration.

Firstly, a panel member of the interior panel 10 is made up of the upper panel member 22 and the lower panel member 24, and the upper panel member 22 is held by the frame 26 having at least the upper frame 28 and the lower frame 30.

Namely, when the panel member of the interior panel is made up of a single panel member, to obtain an enough rigidity of the panel member itself, the thickness of the panel member has to be increased, and this inevitably increases the weight of the panel member, making it impossible to achieve the object of the present invention.

In the case where suspended interior panels disclosed in Patent Documents 3, 4 are assumed to be set so as to face a curtain wall of a showroom, since a height from a floor to a ceiling of such a showroom is greater than that of a general office room, a vertical length (that is, a height) of the interior panel inevitably becomes long. Namely, in the case where the panel member of the interior panel is made up of a single panel (hereinafter, the conventional panel will be referred to as a "single panel member") as in the interior panels disclosed in Patent Documents 3, 4, the thickness of the panel member is reduced to realize a reduction in weight of the interior panel, thereby the rigidity of the panel member is reduced, and a lower portion of the panel member wobbles unfavorably. On the other hand, in the case where the thickness of the panel member is increased to enhance the rigidity of the panel member, the weight of the interior panel is increased unfavorably.

In particular, Patent Document 3 describes that a glass panel of a thickness of 12 mm is used as a "single panel member." An application of such a glass panel to an interior panel for a showroom that needs to be 2.5 m or greater in height cannot be accepted at all because the interior panel becomes heavy.

Then, to solve this problem, in the interior panel 10 according to the embodiment, the panel member of the interior panel 10 is made up of the upper panel member 22 and the lower panel member 24. Namely, the configuration is adopted in which the panel member of the interior panel is divided into two members of the upper panel member 22 and the lower panel member 24, and the lower edge portion 22B of the upper panel member 22 and the upper edge portion 24A of the lower panel member 24 are held by the lower frame 30 of the frame 26.

According to the interior panel 10 of the embodiment, by adopting the configuration described above, even though thicknesses of the panel members (the upper panel member 22 and the lower panel member 24) are made smaller than the thickness of the "single panel member", a rigidity equal to the rigidity required on the "single panel member" can be obtained.

Thus, according to the interior panel 10 and the interior panel structure 100 of the embodiment, the reduction in weight can be realized while satisfying the rigidity.

Additionally, according to the interior panel 10 of the embodiment, the thicknesses of the upper panel member 22 and the lower panel member 24 are preferably 10 mm or smaller. By adopting this configuration, the reduction in weight of the interior panel 10 and the interior panel structure 100 can be effectively achieved. In the description of the present application, the "thickness" means a thickness having a tolerance prescribed under JIS (Japanese Industrial Standards) R 3202: 2011.

According to the interior panel 10 of the embodiment, a vertical length H (refer to FIG. 3) is preferably 2.5 m or greater. By adopting this configuration, the interior panel 10 and the interior panel structure 100 of the embodiment can be set so as to face a curtain wall of a height of 2.5 m or greater. In recent years, most showrooms have a ceiling that is 2.5 m or greater in height, and some of the showrooms have a ceiling that is as high as 6 m. The interior panel 10 of the embodiment can be applied to a curtain wall of such showrooms because the weight of the interior panel 10 is reduced enough for such an application. The vertical length H may be 3 m or greater, 4 m or greater, 5 m or greater, or 6 m or greater.

In the case where the vertical length H of the interior panel 10 is 6 m as an example, lengths in the height direction of the upper panel member 22 and the lower panel member 24 are 3.5 m and 2.5 m, respectively. A width W of the upper panel member 22 is 0.8 m as an example. However, the invention is not limited to the length and the width. The length in the height direction of the upper panel member 22 may be 1.5 in or greater, 2 m or greater, 3 m or greater, or 3.5 m or greater. Additionally, the length in the height direction of the lower panel member 24 may be 1 m or greater, 1.5 m or greater, 2 m or greater, or 2.5 m or greater.

In addition, according to the interior panel 10 of the embodiment, the lower panel member 24 is preferably formed of a transparent member. Since this enables an exterior of the building to be visualized directly through the lower panel member 24 from an interior of the building, scenery effect and fine view effect are enhanced. Additionally, exhibits inside the showroom can be visualized well through the lower panel member 24 from the outside of the building. A sheet of resin such as acryl can be raised as an example of a transparent member, in addition to a glass sheet, which will be described below.

According to the interior panel 10 of the embodiment, the lower panel member 24, which is the transparent member, is preferably a glass sheet. The glass sheet is preferably soda-lime glass (non-strengthened glass), strengthened glass such as chemically strengthened glass or air-cooled strengthened glass, or laminated glass.

When soda-lime glass is used for the lower panel member 24, since the soda-lime glass has superior seeing-through effect, there is provided an advantage that the scenery effect and the fine-view effect are enhanced.

Chemically strengthened glass is a glass sheet to which a known chemical strengthening treatment has been applied. When a chemically strengthened glass is applied to the lower panel member 24, the thickness of the chemically strengthened glass is preferably in a range of 0.1 to 2.0 mm from the viewpoints of increasing residual internal tensile stress and performing the chemical strengthening treatment effectively. This enables the lower panel member 24 to have a thin thickness ranging from 0.1 to 2.0 mm.

Air-cooled strengthened glass is a glass sheet to which a known air-cooling strengthening treatment is applied. When a sheet of air-cooled strengthened glass is applied to the lower panel member 24, a thickness of an air-cooled strengthened glass is preferably in a range of 1.0 to 30 mm from the viewpoints of increasing residual internal tensile stress and performing the air-cooling strengthening treatment. This enables the lower panel member 24 to have a thin thickness ranging from 1.0 to 10 mm.

Laminated glass is a known glass sheet formed by laminating two sheets of glass together with an interlayer of polyvinyl butyral resin, ethylene-vinyl acetate resin, ionomer resin (SG: SENTRYGLAS, a product of DU PONT, a registered trademark) or the like interposed between the two sheets of glass. Application of such laminated glass to the lower panel member 24 can prevent the glass sheet from spreading into pieces of glass when the glass sheet is broken. Additionally, application of the chemically strengthened glass or the air-cooled strengthened glass to a glass sheet of a laminated glass results in the lower panel member 24 that is thin and light.

According to the interior panel 10 of the embodiment, the upper panel member 22 is preferably formed of a member having a lower solar direct transmittance than that of the lower panel member 24. Glass having low solar direct transmittance and high visible light transmittance such as colored glass, heat absorbing glass or heat reflecting glass can be raised as an example of a member for use in this case.

According to the interior panel 10 of the embodiment, the heat shielding performance of the interior panel 10 can be enhanced by forming the upper panel member 22 of such a member having a low solar direct transmittance. Namely, a reduction in cooling efficiency in an interior (a showroom) of a building in summer season can be prevented by imparting the heat shielding performance to the upper panel member 22 on to which solar light is shone directly for many hours. Similarly, the lower panel member 24 as well as the upper panel member 22 may be formed of the member having a low solar direct transmittance. In this case, a glass sheet having high visible light transmittance is preferably used for the lower panel member 24 because the seeing-through effect such as scenery effect and fine view effect is more important on the lower panel member 24 than on the upper panel member 22. When referred to herein, the solar direct transmittance is a value calculated using a calculation method complying with JIS R3106: 1998.

According to the interior panel 10 of the embodiment, the upper panel member 22 is preferably formed of a member having a function of a heat shielding performance or an anti-glare performance. The colored glass or the heat absorbing glass can be exemplified as a member having the heat shielding performance as its function, and in addition to these types of glass, a glass sheet having a high heat shielding and thermal insulating performance such as one having a Low-E coating on a surface can also be exemplified.

A glass sheet to which an anti-glare treatment is applied can be exemplified as the member having the anti-glare performance for use for the upper panel member 22. In the anti-glare treatment, a desired pattern of irregularities is formed on a surface of the glass sheet. A frosting treatment is known as one of anti-glare treatments. According to this frosting treatment, a surface of a glass sheet is submerged in a mixed solution of hydrogen fluoride and ammonium fluoride to etch the surface of the glass sheet, whereby a desired pattern of irregularities is formed on the surface of the glass sheet.

According to the interior panel 10 of the embodiment, the material of the upper panel member 22 is not limited to glass, and hence, the upper panel member 22 may be formed of resin, metal or cloth. Although the glass sheet is used for the upper panel member 22 in the example described above, the object of the present invention is to provide the interior panel 10 that can reduce its weight. Consequently, any material other than the glass material described above can be used for the upper panel member 22 as long as a material selected for use can help to realize a reduction in weight which is the object of the invention. Then, in the interior panel 10 of the embodiment, for example, panel members of resin such as acryl, metal such as aluminum and cloth such as cotton are exemplified as the upper panel member 22.

When the upper panel member 22 is formed of cloth, the resulting upper panel member 22 has low solar direct transmittance and has the heat shielding performance or the anti-glare performance as its function. Although the rigidity of the upper panel member 22 formed of cloth becomes lower than that of the upper panel member 22 formed of glass, resin and metal, there will be no problem with the overall rigidity of the interior panel 10 since the lower panel member 24 is formed of the rigid transparent member such as the glass sheet or a acryl sheet.

When the upper panel member 22 is formed of cloth, the frame 26 preferably has the left frame 32 and the right frame 34. The rigidity of the upper panel member 22 is enhanced by providing the left frame 32 and the right frame 34 on the frame 26, thereby making it possible to enhance the overall rigidity of the interior panel 10.

Returning to FIG. 2, FIG. 2 illustrates the front view of the main part of the interior panel structure 100 including a plurality of (three) interior panels 10 that are laid on in the horizontal direction. In other words, FIG. 2 illustrates a form of the interior panel structure 100 in which a plurality of (three) upper panel members 22 are laid on in the horizontal direction in such a way that no gap is provided between the adjacent upper panel members 22.

Here, although the left and right edge portions of the upper panel member 22 are held by the corresponding left and right frames, a left edge portion 24C and a right edge portion 24D of the lower panel member 24 are not held by left and right frames to reduce the weight of the interior panel 10, and end faces of the left and right edge portions are exposed. Due to this, a left edge portion 24C and a right edge portion 24D of the lower panel member 24 need to be prevented from being brought into contact with a right edge portion 24D and a left edge portion 24C of the other adjacent lower panel members 24. In particular, when the lower panel member 24 is formed of a glass sheet, end faces of the glass sheets have to be prevented from being damaged due to the contact described above.

Then, according to the interior panel 10 of the embodiment, a transverse width A of the lower panel member 24 is made smaller than a transverse width W of the frame 26, and the left edge portion 24C and the right edge portion 24D of the lower panel member 24 are disposed inward of lateral surfaces of the frame 26. By adopting this configuration of the interior panel 10, even though the interior panel structure 100 is configured as illustrated in FIG. 2, the left edge portion 24C and the right edge portion 24D of the lower panel member 24 are not brought into contact with the right edge portion 24D and the left edge portion 24C of the other lower panel members 24 adjacent thereto in the horizontal direction. Thus, the left edge portion 24C and the right edge portion 24D of the lower panel member 24 can be prevented from being brought into contact with the right edge portion 24D and the left edge portion 24C of the other lower panel members 24 adjacent thereto. This can prevent the lower panel members 24 from being damaged by the contact with the other lower panel members 24. This configuration of the interior panel 10 is effective in particular when the lower panel member 24 is formed of the glass sheet.

In addition, with the interior panel structure 100 configured in the way illustrated in FIG. 2, a gap 36 extending along the vertical direction is defined between the two adjacent lower panel members 24. This gap 36 functions as an opening for ventilation of the double-skin facade structure. Hereinafter, the opening for ventilation will be described.

Figure 6:
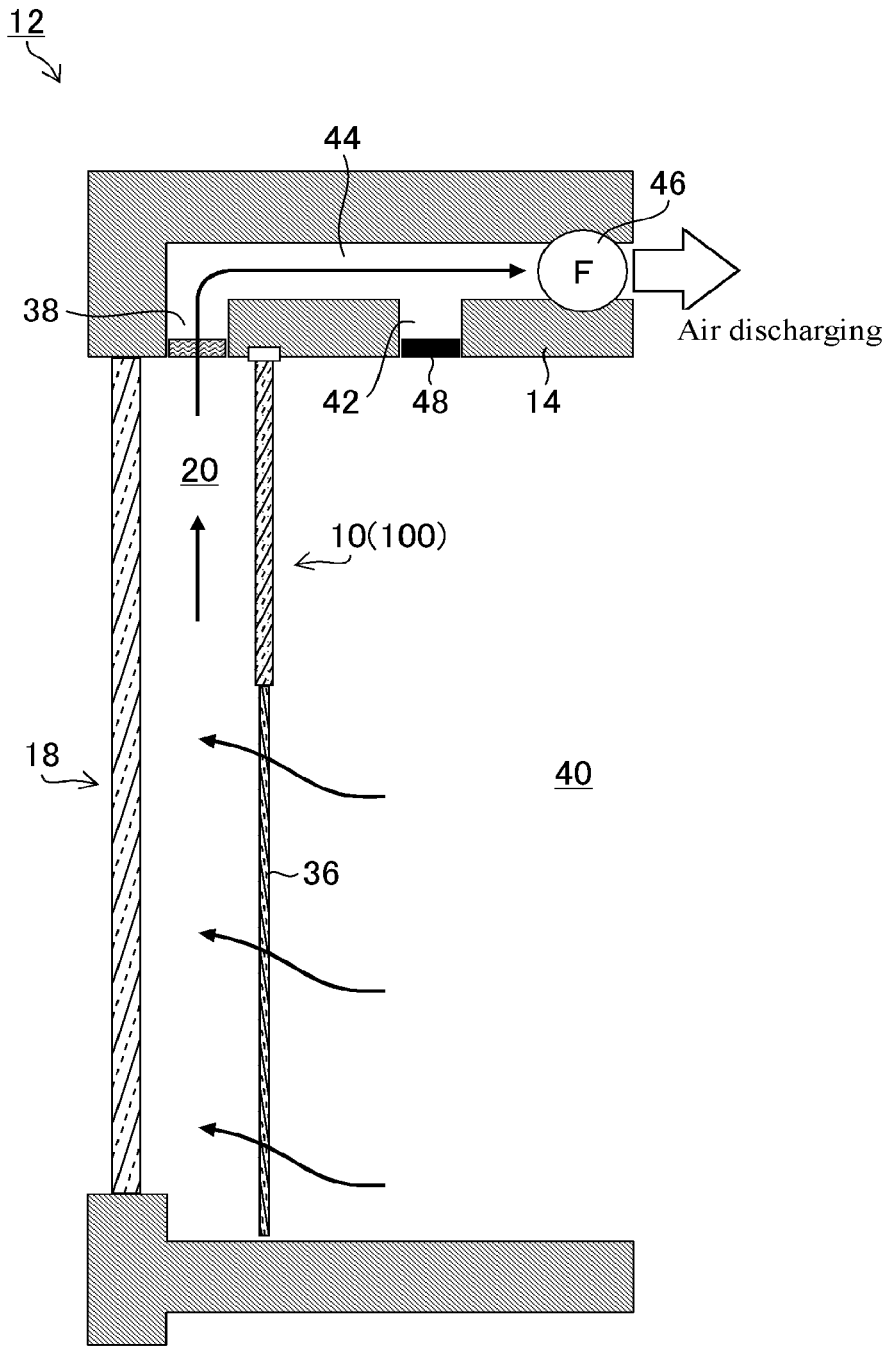
FIG. 6 is a schematic section view of a double-skin facade structure, illustrating an air discharging operation performed in a summer season.
Figure 7:
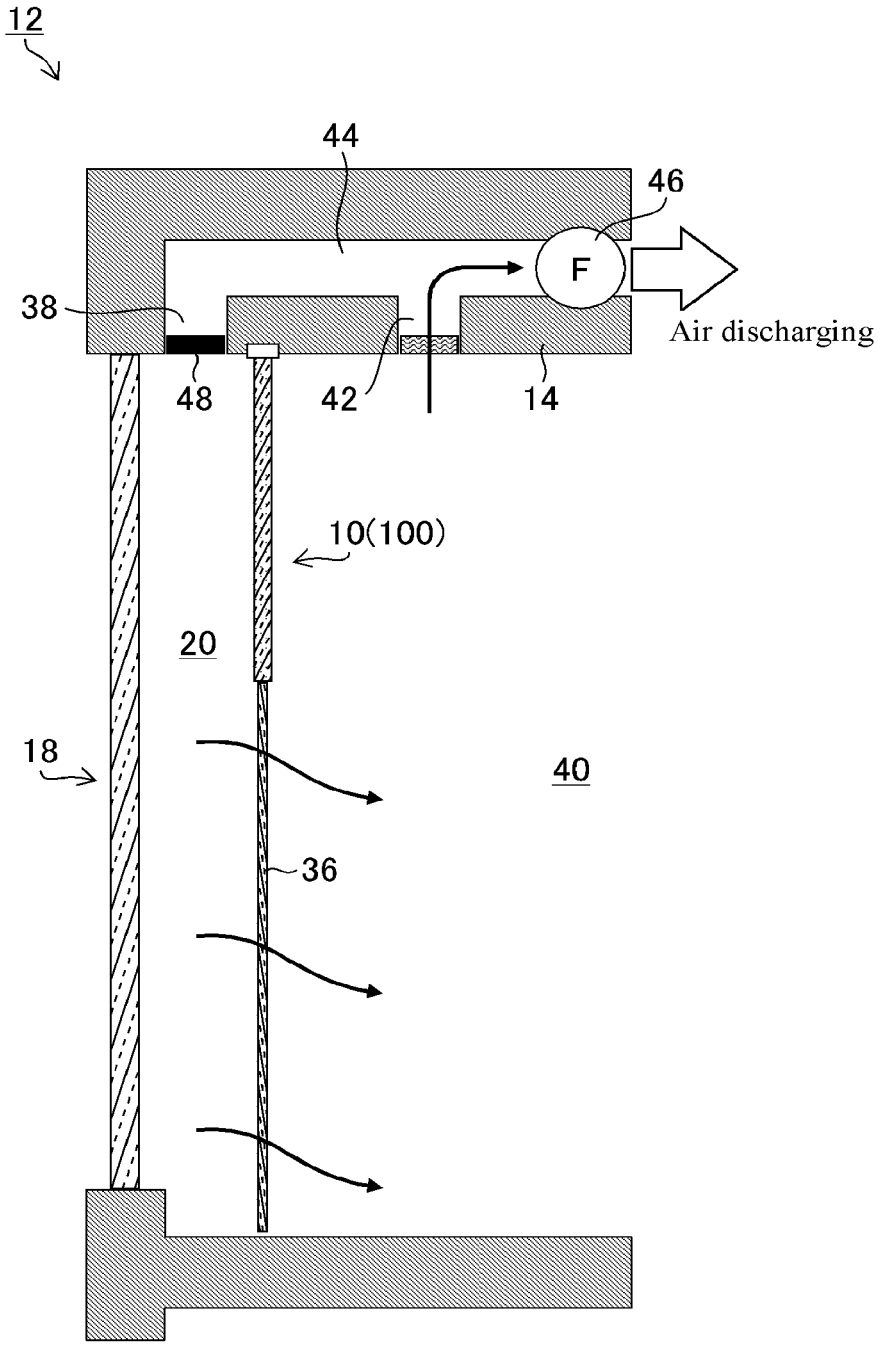
FIG. 7 is a schematic section view of the double-skin facade structure, illustrating an air discharging operation performed in a winter season.

FIGS. 6 and 7 illustrate schematic section views of the double-skin facade structure shown in FIG. 1. FIG. 6 illustrates an air discharging operation performed in summer season, and FIG. 7 illustrates an air discharging operation performed in winter season. In FIGS. 6 and 7, arrows denote directions of air flows. Additionally, in FIGS. 6 and 7, the detailed structure of the interior panel 10 is omitted from illustration.

As FIGS. 6 and 7 illustrate, an air inlet port 38 communicating with the cavity 20 and an air inlet port 42 communicating with a room interior 40 are provided in the ceiling portion 14 of the building 12. These air inlet ports 38, 42 communicate with an air discharging fan 46 through a duct 44, and an air outlet port (not shown) of the duct 44 is opened to an exterior of the building 12.

In the summer season operation shown in FIG. 6, the air inlet port 42 is closed with a cap 48, and the air discharging fan 46 is driven. This enables inside air in the cavity 20 warmed by solar radiation is drawn out from the air inlet port 38 and is then discharged to an outside of the building 12 through the duct 44. Since inside air in the room interior 40 flows into the cavity 20 through the gaps 36 shown in FIG. 2 that function as the opening for ventilation, inside air in the cavity 20 can be discharged smoothly, and warmed inside air is prevented from flowing reversely from the gaps 36 into the room interior 40.

On the other hand, in the winter season operation shown in FIG. 7, the air inlet port 42 is left open, while the air inlet port 38 is closed with the cap 48, and the air discharging fan 46 is driven. This enables inside air in the cavity 20 that is warmed by solar radiation is drawn into the room interior 40 from the gaps 36 that function as the opening for ventilation, and therefore, inside air in the room interior 40 can be warmed up by the inside air from the cavity 20. Thereafter, the inside air in the room interior 40 is discharged from the air inlet port 42 to the outside of the building 12 through the duct 44.

Consequently, as FIG. 2 illustrates, the opening for ventilation that is necessary in the double-skin facade structure can be ensured in the interior panel structure 100 by forming the gap 36 between the two adjacent lower panel members 24.

Next, referring to the drawings, the configuration of the interior panel 10 will be described in detail.

Figure 8:
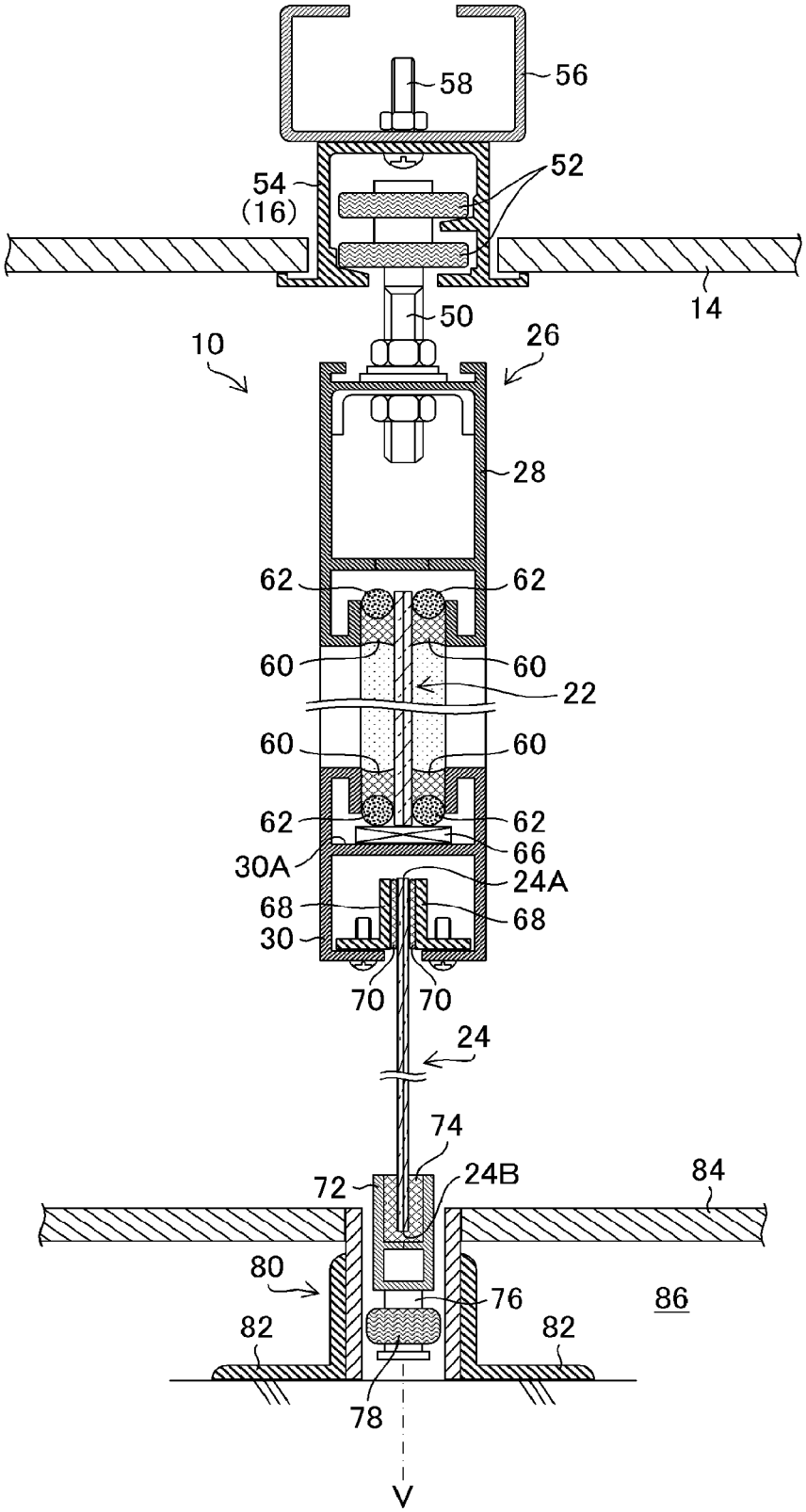
FIG. 8 is a detailed longitudinal section view of the interior panel.

FIG. 8 is a longitudinal section view of the interior panel 10.

Two rods 50 (refer to FIG. 3) are provided on the upper frame 28 of the frame 26 of the interior panel 10 so as to project upwards, and a pair of suspending wheels 52 are provided at an upper end of each of the rods 50. These suspending wheels 52 are movably engaged with a hanger rail 54 that is a railway laid on the ceiling portion 14. The hanger rail 54 is fixed to a substrate material 56 with a bolt 58.

The upper panel member 22 held by the frame 26 adopts, for example, laminated glass to a surface of which an anti-glare treatment is applied. Two sheets of glass making up the laminated glass each have a thickness of 0.8 mm, and an interlayer has a thickness of 1 mm. Thus, the weight is reduced accordingly.

The upper edge portion 22A, the lower edge portion 22B, the left edge portion 22C and the right edge portion 22D, shown in FIG. 4, of the upper panel member 22 are held by the upper frame 28, the lower frame 30, the left frame 32 and the right frame 34, respectively, via sealants 60 and backers 62 shown in FIG. 8. Additionally, the lower edge portion 22B of the upper panel member 22 is mounted on a bottom surface 30A of the lower frame 30 via a setting block 66.

As an example of a material for the lower panel member 24, laminated glass, which is formed into a transparent member, is adopted. Glass sheets making up the laminated glass have, for example, a thickness of 0.8 mm, and an interlayer has a thickness of 1 mm. This configuration contributes to realization of the reduction in weight as with the upper panel member 22.

The upper edge portion 24A of the lower panel member 24 is held with a pair of metal fixtures 68, each having an L-shaped section, via an adhesive material 70 such as a sealant or an adhesive tape at a lower portion of the lower frame 30. A lower frame 72 is fixed to the lower edge portion 24B of the lower panel member 24 via an adhesive material 74. A pin 76 is provided at a lower portion of the lower frame 72 so as to project downwards, and a guide roller 78 is attached to a lower portion of the pin 76 so as to rotate about a vertical axis V of the guide roller 78.

The guide roller 78 is brought into sliding contact with a support member 80 laid underneath a floor portion 84 of the building 12, or is inserted in the support member 80 with a predetermined gap defined between the support member 80 and the guide roller 78. Namely, the interior panel structure 100, which is made up of the plurality of interior panels 10, has the support member 80 configured to support the lower edge portions 24B of the lower panel members 24. Additionally, the support member 80 of the embodiment is provided in a floor chamber 86 underneath the floor portion 84 so as not to be visualized by visitors of the showroom. This configuration of the interior panel structure 100 of this embodiment improves the design of the interior panel structure 100 in relation to its external appearance.

The support member 80 is provided to extend along the hanger rail 54 in a position directly below the hanger rail 54. The support member 80 includes a pair of rails 82, each having an L-shaped section, which are disposed so as to hold the guide rollers 78 between them. The interior panels 10 are restrained from wobbling as a result of the guide roller 78 being brought into contact with those rails 82. In the interior panel structure 100 whose weight is reduced, as a result of including the support member 80, the wobbling of the interior panels 10 caused by, for example, a flow of air from an air conditioner can be restrained by the support member 80.

Figure 9:
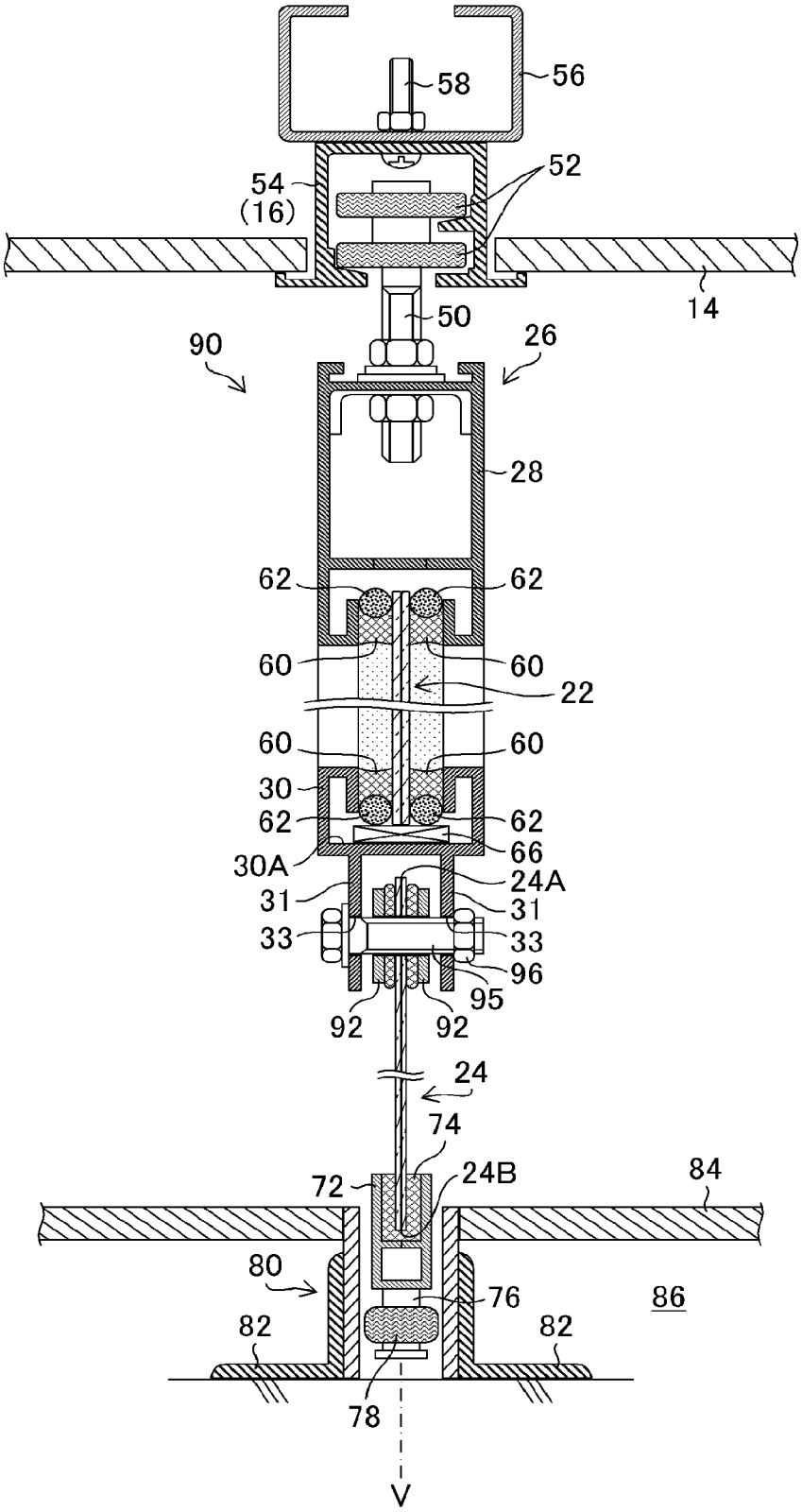
FIG. 9 FIG. 9 is an explanatory drawing illustrating a modified example made to the interior panel shown in FIG. 8.

FIG. 9 illustrates an interior panel 90 which is a modified example made to the interior panel 10 shown in FIG. 8. In describing the interior panel 90, like reference numerals will be given to like or similar portions to those of the interior panel 10 shown in FIG. 8, and descriptions of those like portions will be omitted here.

The interior panel 90 differs from the interior panel 10 in a holding structure of a lower panel member 24 to a lower frame 30. To describe this specifically, as shown in an enlarged perspective view of a main part of the lower panel member 24 shown in FIG. 10, a through hole 25 is formed in each of two upper corner portions of the lower panel member 24. A short strip-shaped plate 92 is fixed to each side of an upper portion of the lower panel member 24 via an adhesive material 94 along an upper edge portion 24A of the lower panel member 24. Through holes 93, communicating with the through holes 25, are formed in these plates 92. The plates 92 are made of, for example, stainless steel.

As FIG. 9 illustrates, a pair of flanges 31 are provided at a lower portion of a lower frame 30 so as to project downwards, and the upper edge portion 24A of the lower panel member 24, to which the plates 92 are bonded, is inserted between the pair of flanges 31. A through hole 33 is formed in each of the flanges 31 so that a bolt 95 is inserted through it.

The lower panel member 24, to which the plates 92 are bonded, is held with the lower frame 30 through the following procedure.

Firstly, the upper edge portion 24A of the lower panel member 24 is inserted between the pair of flanges 31 of the lower frame 30 together with the plates 92. At this time, the through holes 25, 93 are made to coincide with the through holes 33.

Next, bolts 95 are inserted through the through holes 33, 93, 25, 93 from outsides of the through holes 33 of one of the flanges 31, and nuts 96 are tightened on threaded portions of the bolts 95 that project from the through holes 33 of the other flange 31. The lower panel member 24 is held with the lower frame 30 to thereby be suspended and supported, by the procedure described above.

Figure 11:
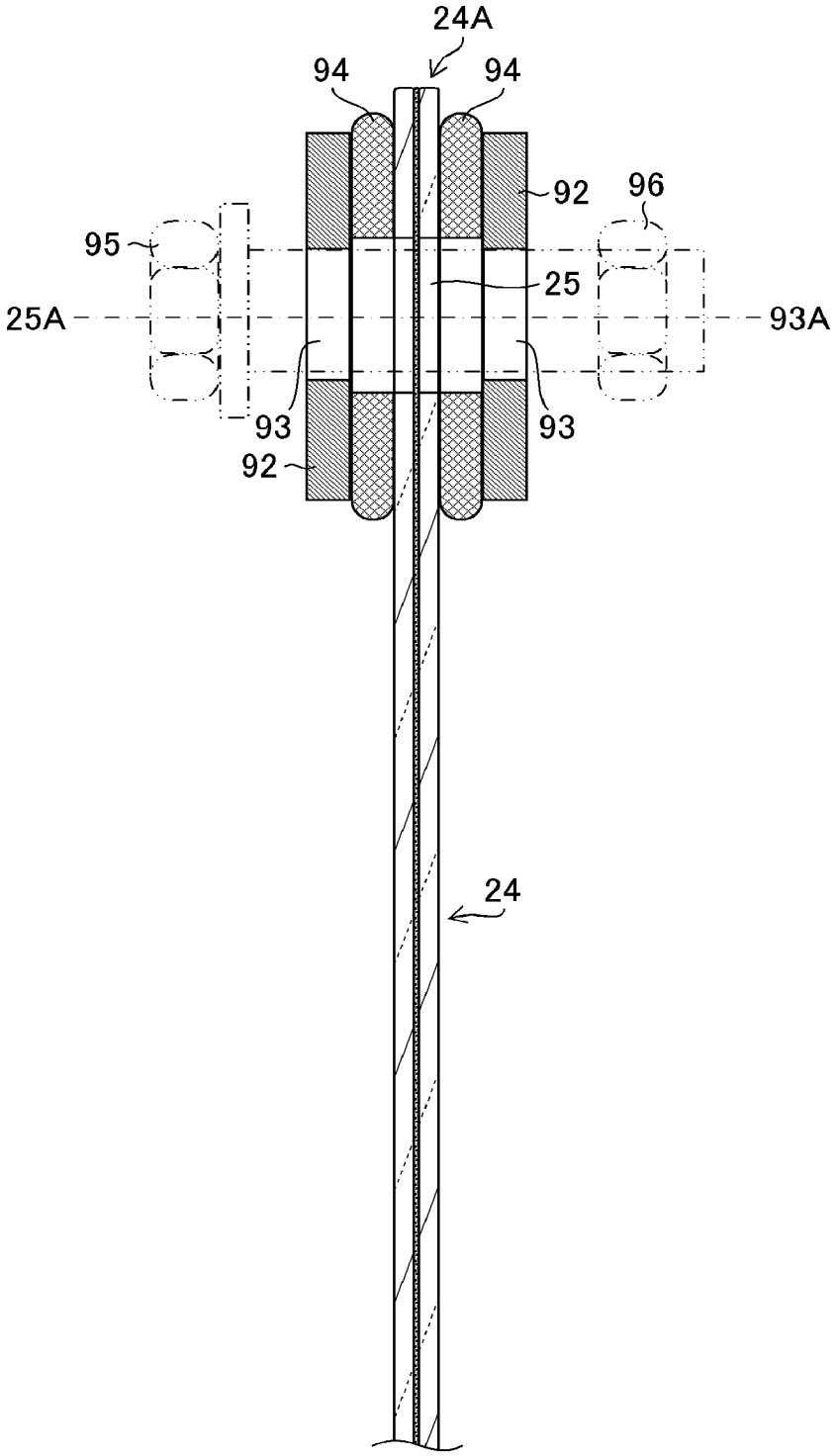
FIG. 11 is an enlarged perspective view of a main part of a lower panel member.

Incidentally, as shown in an enlarged section view of a main part of the lower panel member 24 shown in FIG. 11, in the through holes 25 and the through holes 93, a center axis 25A of the through holes 25 and a center axis 93A of the through holes 93 coincide with each other, and the through holes 25 are formed greater in diameter than the through holes 93.

By configuring the through holes 25 and the through holes 93 in the way described above, when the lower panel member 24 is suspended and supported with the lower frame 30 by the bolts 95 as shown in FIG. 9, the bolts 95 do not contact circumferential portions of the through holes 25 but contact circumferential portions of the through holes 93, and the lower panel member 24 is suspended and supported with the lower frame 30 in that state.

Namely, the plates 92 come to bear the weight of the lower panel member 24 when the lower panel member 24 is suspended and supported with the lower frame 30 by configuring the through holes 25 and the through holes 93 in the way described above. According to the interior panel 90 shown in FIG. 9, by adopting the configuration described above, a damage can be prevented which would otherwise be made to the lower panel member 24 due to the contact of the bolts 95 to the circumferential portions of the through holes 25 of the lower panel member 24, which is formed of laminated glass.

Figure 10:
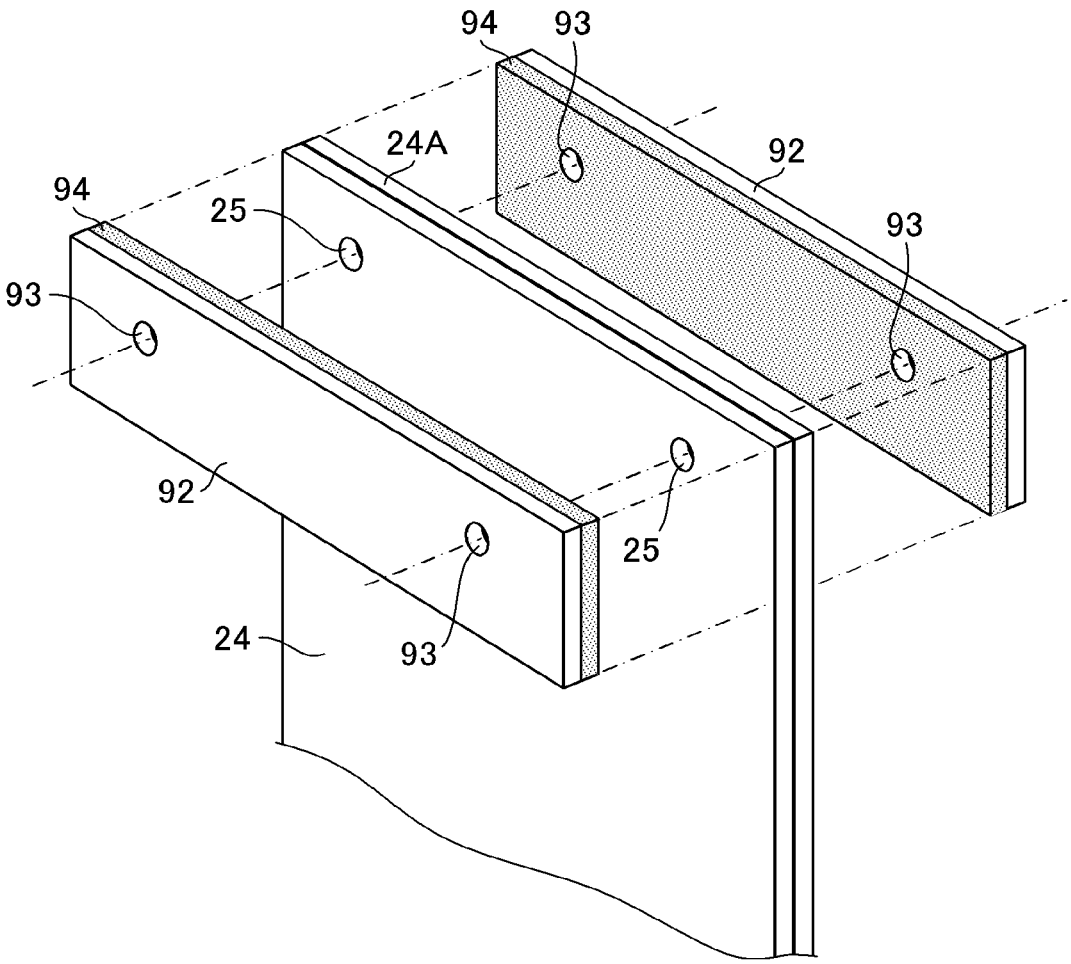
FIG. 10 is an enlarged perspective view of a main part of a lower panel member.

Although the panel members are described as being formed of laminated glass in the embodiment shown in FIGS. 8 to 10, the invention is not limited to such laminated glass. For example, the upper panel member may be formed of a single glass sheet, a resin panel member, a metallic panel member, or a cloth panel member. The lower panel member may be formed of a single glass sheet or a resin panel member.

While the interior panel 10 is described as being applied to the inner skin of the double-skin facade structure in the embodiment, the interior panel of the invention can also be used as a partition wall.

While the interior panel 10 is described as being made up of the two panel members of the upper panel member 22 and the lower panel member 24 in the embodiment, the interior panel of the present invention includes an interior panel having a central panel member between the upper panel member 22 and the lower panel member 24. Namely, any interior panel including at least the upper panel member 22 and the lower panel member 24 is included in the interior panel of the present invention.

While the transparent member having the good seeing-through effect is described as being used as the lower panel member 24 in the embodiment, a graphic display transparent member in which a graphic display module is held between two transparent base materials may be used as the lower panel member 24 instead of the transparent member. Additionally, this graphic display transparent member may be used as the upper panel member 22.

DESCRIPTION OF REFERENCE NUMERALS

10 Interior panel;
12 Building;
14 Ceiling portion;
16 Railway;
18 Outer skin;
20 Cavity;
22 Upper panel member;
24 Lower panel member;
25 Through hole;
26 Frame;
28 Upper frame;
30 Lower frame;
31 Flange;
32 Left frame;
33 Through hole;
34 Right frame;
36 Gap;
38 Air inlet port;
40 Room interior;
42 Air inlet port;
44 Duct;
46 Air discharging fan;
48 Cap;
50 Rod;
52 Suspending wheel;
54 Hanger rail;
56 Substrate material;
58 Bolt;
60 Sealant;
62 Backer;
66 Setting block;
68 Metallic fixture;
70 Adhesive material;
72 Lower frame;
74 Adhesive material;
76 Pin;
78 Guide roller;
80 Support member;
82 Rail;
84 Floor portion;
86 Floor chamber;
90 Interior panel;
92 Plate;
93 Through hole;
94 Adhesive material;
95 Bolt;
96 Nut;
100 Interior panel structure

The invention claimed is:

1. An interior panel configured to be suspended and supported movably along a railway laid on a ceiling portion of a building, the interior panel comprising:

an upper panel member;

a lower panel member disposed below the upper panel member; and a frame comprising at least an upper frame member configured to be attached movably along the railway and a lower frame member holding a lower edge portion of the upper panel member and to hold an upper edge portion of the lower panel member, wherein the lower panel member is held with the lower frame to thereby be suspended and supported, wherein the lower panel member has a left edge portion not held by a left frame member and a right edge portion not held by a right frame member, and wherein a thickness of the frame is substantially greater than a thickness of the upper panel member and a thickness of the lower panel member.

2. The interior panel according to claim 1, wherein the upper panel member and the lower panel member have a thickness of 10 mm or less, respectively.

3. The interior panel according to claim 1, which has a vertical length of 2.5 m or more.

4. The interior panel according to claim 1, wherein the lower panel member comprises a transparent member.

5. The interior panel according to claim 4, wherein the transparent member is a glass sheet.

6. The interior panel according to claim 1, wherein the upper panel member comprises a member having a lower solar direct transmittance than a solar direct transmittance of the lower panel member.

7. The interior panel according to claim 1, wherein the upper panel member comprises a member having a function of a heat shielding performance or an anti-glare performance.

8. The interior panel according to claim 1, wherein the upper panel member comprises a glass, resin, metal or cloth.

9. An interior panel structure comprising a plurality of the interior panels according to claim 1 disposed along the railway laid on the ceiling portion of the building.

10. The interior panel structure according to claim 9, wherein the frame of the interior panel has a left frame member holding a left edge portion of the upper panel member and a right frame member holding a right edge portion of the upper panel member, and a transverse width of the lower panel member of the interior panel is smaller than a transverse width of the frame, and a left edge portion and a right edge portion of the lower panel member are disposed inside the bounds of the left frame member and the right frame member, respectively.

11. The interior panel structure according to claim 9, comprising a support member supporting a lower edge portion of the lower panel member of the interior panel, in a floor portion of the building.

12. The interior panel structure according to claim 9, which is disposed on an interior side of an outer skin provided on an outer circumferential surface of the building, with a cavity interposed between the interior side of the outer skin and the interior panel structure.

13. The interior panel structure according to claim 1, wherein the upper edge portion of the lower panel member is held with a pair of metal fixtures via an adhesive material at a lower portion of the lower frame.

14. An interior panel to be suspended and supported movably along a railway laid on a ceiling portion of a building, comprising:

an upper panel member;

a lower panel member disposed below the upper panel member;

a frame comprising at least an upper frame member to be attached movably along the railway and a lower frame member configured to hold a lower edge portion of the upper panel member and to hold an upper edge portion of the lower panel member; and a plate disposed between the upper edge portion of the lower panel member and an outside wall portion of the lower frame member, wherein the lower panel member, the plate and the lower frame member include through holes and are secured by bolts inserted in the through holes.

15. The interior panel structure according to claim 14, wherein the plate is fixed to the upper edge portion of the lower panel member via an adhesive material.

* * * * *